United States Patent [19]

Whiteman, Jr.

[11] Patent Number: 4,843,714

[45] Date of Patent: Jul. 4, 1989

[54] MULTIPLE LINE, AUTOMATIC KEY PROGRAMMING AND CONNECTOR TRANSFER SYSTEM

[75] Inventor: Robert N. Whiteman, Jr., Middletown, Pa.

[73] Assignee: AMP Incorporated, Harrisburg, Pa.

[21] Appl. No.: 168,790

[22] Filed: Mar. 15, 1988

[51] Int. Cl.[4] ..... H01R 43/16

[52] U.S. Cl. ..... 29/874; 29/876; 29/747

[58] Field of Search ..... 29/857, 874, 876, 747, 29/748

[56] References Cited

U.S. PATENT DOCUMENTS

| | | | |
|---|---|---|---|
| 3,061,147 | 10/1962 | Vilmerding . | |
| 3,448,507 | 6/1969 | Jackson et al. . | |
| 3,474,395 | 10/1969 | Ferdon et al. . | |
| 3,518,620 | 6/1970 | Bushey et al. . | |
| 3,562,696 | 2/1971 | Barnhart et al. . | |
| 3,611,272 | 10/1971 | Fairbairn . | |
| 3,851,369 | 12/1974 | Escholz | 29/211 |
| 3,873,172 | 3/1975 | Paullus . | |
| 4,376,565 | 3/1983 | Bird et al. . | |
| 4,448,467 | 5/1984 | Weidler . | |
| 4,449,767 | 5/1984 | Weidler . | |
| 4,580,868 | 4/1986 | Verstijnen . | |
| 4,587,703 | 5/1986 | Azizi et al. | 29/431 |
| 4,595,250 | 6/1986 | Joly et al. | 339/17 |
| 4,653,185 | 3/1987 | Kajima et al. | 29/809 |

FOREIGN PATENT DOCUMENTS

| | | |
|---|---|---|
| 0110487 | 12/1983 | European Pat. Off. . |
| 135323 | 5/1979 | Fed. Rep. of Germany . |
| 60-94234 | 5/1985 | Japan . |
| 8000935 | 5/1980 | PCT Int'l Appl. . |
| 8404210 | 10/1984 | PCT Int'l Appl. . |
| 1292972 | 2/1987 | U.S.S.R. . |
| 1066672 | 4/1967 | United Kingdom . |

OTHER PUBLICATIONS

Standard Search Report DTD 01/11/89.
STD Search Report Annex.
One Page Document Entitled "Insertion Error-Proof Board-To-Board Cable Connector", AMP Instruction Sheet IS7482 Rel. 03/26/84.

*Primary Examiner*—Howard N. Goldberg
*Assistant Examiner*—Taylor J. Ross
*Attorney, Agent, or Firm*—David L. Smith

[57] ABSTRACT

An automatic key programming and connector transfer system and method for electrical connectors (10) having keying means (40) thereon includes a supply station (56) for storing a plurality of connectors (10) having keys in an unprogrammed orientation; a programming station (57) for receiving connectors (10) from the supply station (56) and for programming the keys, the programming station (57) including a programming device (100) responsive to programming instructions applied thereto; and an output station (58) for receiving connectors (10) having keys programmed to a desired orientation, the output station (58) including a plurality of output station sections (**80*a*–80*f*) each of which are adapted to receive connectors which have keys programmed to a predetermined one of the plurality of possible programmed states; and monitoring means (60) for monitoring each section (80*a*–80*f*) and for controlling the programming device (100) to program the keys of connectors (10) to maintain an adequate supply in each section. The system may include robotic transfer apparatus (52**).

18 Claims, 7 Drawing Sheets

56
67a
64
10b
10a
57
100
71
72
101b
73
101a
76

MULTIPLE LINE, AUTOMATIC KEY PROGRAMMING AND CONNECTOR TRANSFER SYSTEM

BACKGROUND OF THE INVENTION

The present invention relates generally to the field of electrical connectors, and, more particularly, to an automatic programming and transfer system and method for electrical connectors which have keying means thereon.

Electrical connectors are frequently provided with keying means to permit particular pairs of connectors to properly mate and to prevent the mating of connectors which are not intended to be mated. Keying means are especially useful when a plurality of identical connectors is positioned in close proximity to one another, for example, on a printed circuit board. The incorrect matching of complementary connectors to the connectors on the board can cause serious damage to the circuits improperly connected thereby; and the keying means, by ensuring that each complementary connector will mate with only the correct one of the plurality of connectors on the board, minimizes the risk of improper connection. Keying means are particularly important when the connections are made by untrained personnel as the risk of improper connection is especially great in such circumstances.

Keying systems are known in which a key is secured in one of a pair of complementary connectors and is adapted to cooperate with an opposing key secured in an associated other of the pair of connectors. Each key is secured in its connector in a selected orientation with respect to its opposing key so that when the connectors are intended to be mated, extended keying portions on the keys pass by each other during mating to allow the connectors to properly mate. If one of the keys is secured in an incorrect orientation with respect to its opposing key, however, the extended keying portions on the keys abut one another during attempted mating to prevent proper mating of the connectors.

One known type of key includes a portion having a polygonal cross section and is adapted to be secured within a passageway in a connector in a selected orientation. The number of sides of the polygonal shape determines the number of possible orientations of the key.

Sometimes keys of the connectors are programmed in the factory by the manufacturer and the connectors with programmed keys are shipped to the customer with the keys pre-programmed in a variety of orientations. In such circumstances it is usually necessary for the customer to maintain a rather large inventory of connectors to ensure that an adequate supply of connectors with differently programmed keys will be available when needed. At other times, the connectors are shipped to the customer with the keys in an unprogrammed condition, and the customer programs the keys of the connectors by inserting and then securing the keys in the connector passageways in the selected orientations prior to mounting the connectors to printed circuit boards or other utilization devices.

Whether performed by the manufacturer or the customer, programming the keys of a connector and positioning the connector having programmed keys on a utilization device are typically performed by hand, and are time-consuming procedures that are susceptible to human error. The programming of the keys of small connectors is particularly troublesome inasmuch as the keys also tend to be quite small and rather difficult to handle.

SUMMARY OF THE INVENTION

According to one aspect of the invention, an automatic key programming apparatus for electrical connectors is provided which comprises a supply station for storing a plurality of connectors having unprogrammed keys, each of the connectors having at least one key that is programmable to any selected one of a plurality of programmed states; a programming station for receiving connectors having unprogrammed keys from the supply station and for programming the keys of the connectors, the programming station including a programming device for programming the keys of each connector to a particular programmed state in accordance with programming instructions applied thereto; an output station for receiving connectors having keys programmed to a desired orientation from the programming station, the output station including a plurality of output station sections each of which are adapted to receive connectors in which the keys are programmed to a different one of the plurality of programmed states; and monitoring means for monitoring each output station section and for providing programming instructions to the programming device for maintaining a supply of connectors having keys programmed to the state stored in respective output stations in each of the plurality of output station sections.

According to a presently preferred embodiment, the multiple line, automatic key programming apparatus of the invention is particularly designed for use with connectors which have at least one key mountable thereon in a programmable first position whereby the key may be rotated to any selected one of a plurality of orientations, for example, six orientations, and, thereafter, moved to a programmed second position in which the key is locked in the connector in the selected orientation. The supply station includes means for storing a plurality of connectors having keys mounted thereon in the programmable first position, and first delivery means for delivering the connectors having unprogrammed keys, one at a time, to the programming station. The programming station includes a programming device which first rotates the keys of each connector to a selected orientation in accordance with the programming instructions applied thereto, and then locks the keys in the programmed second position; and second delivery means for thereafter delivering the connectors having keys programmed to a desired orientation, one at a time, to the output station. The output station includes a plurality of output tracks, each of which is adapted to receive connectors having keys which are programmed to a different one of the possible orientations; and the second delivery means includes means for directing each connector having programmed keys to the appropriate output track. Each output track is adapted to store a plurality of connectors having programmed keys until they are picked up for use, for example, to be mounted to a printed circuit board or other utilization device.

The monitoring means monitors each output track, and when the number of connectors in a particular track decreases to a predetermined value, e.g., three connectors, the monitoring means initiates operation of the programming device to program the keys of connectors to the programmed state stored in that track. In this manner, each output track will maintain an adequate supply of connectors with keys programmed to the state stored in that track for use at all times.

The first and second delivery means preferably include inclined paths for delivering connectors from the supply station to the programming station and from the programming station to the output station by gravity whereby the connectors move from one station to the next in an efficient and reliable manner during operation of the apparatus.

With the automatic key programming apparatus of the present invention, a limited but adequate supply of connectors with keys programmed to various orientations is maintained at all times without it being necessary to maintain a large inventory of connectors with keys programmed to various orientations. Furthermore, the automatic key programming apparatus operates independently of the utilization device or of the means used for transferring connectors to the utilization device, thus substantially simplifying the apparatus.

According to a further aspect of the invention, the automatic key programming apparatus is incorporated within an automatic key programming and connector transfer system which also includes robotic transfer apparatus for automatically transferring a connector with keys programmed to predetermined orientations from the programming apparatus to a printed circuit board or other utilization device. More particularly, the robotic transfer apparatus is designed to pick-up connectors with keys programmed to predetermined orientations, one at a time, as needed from the appropriate one of the output tracks of the output station of the multiple line key programming apparatus and to transfer the connector to and position the connector on a utilization device in an efficient reliable manner substantially without operator intervention.

Further advantages and specific details of the invention will become apparent hereinafter in conjunction with the following detailed description of a presently preferred embodiment.

DETAILED DESCRIPTION OF THE PREFERRED EMBODIMENT

Figure 1:
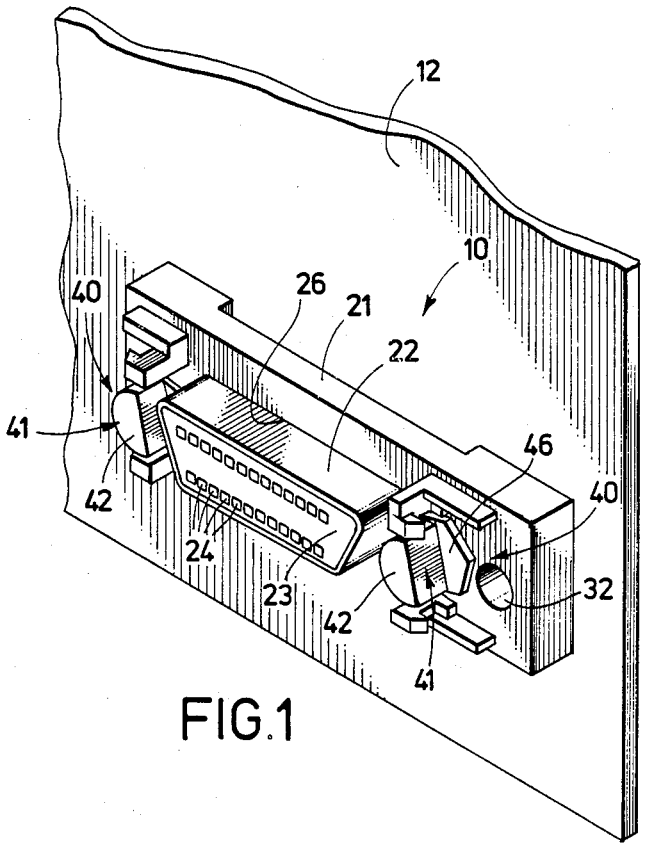
FIG. 1 illustrates an electrical connector assembly having programmable keys with which the multiple line automatic key programming and connector transfer system of the present invention may be utilized.

FIG. 1 illustrates an electrical connector 10 having programmable keys, with which the automatic key programming and connector transfer system of the present invention may be utilized. Connector 10 includes a housing 21, a drawn metal shroud 22, and a header 23 of a suitable insulating material. Header 23 has a plurality of passageways 24 extending therethrough for receiving female contacts (not shown) and is supported within shroud 22. Shroud 22 is, in turn, supported within D-shaped polarizing aperture 26 in housing 21 to form connector 10.

Connector 10 is adapted to be mounted to a printed circuit board 12 or other utilization device by extending mounting screws (not shown) through threaded mounting apertures 32 in the housing as is known to those skilled in the art.

Connector 10 is particularly designed for use in applications in which a plurality of identical connectors is mounted in close proximity to one another. For example, printed circuit board 12 can comprise a panel for a computer or the like and contain a plurality of connectors 10 to permit various external equipment to be connected to the computer via complementary connectors coupled to the external equipment by cables or the like. In such applications, it is important to ensure that each connector be mated with the correct complementary connector as mismatching of connector pairs can result in damage to electrical circuits improperly connected thereby.

To ensure that each connector 10 can mate with only the correct complementary connector, the connectors include keying systems to prevent incorrect connector pairs from being mated. In particular, connector 10 includes a keying system 40 comprising a pair of keys 41 mounted adjacent opposite ends of housing 21 and which include keying portions 42 which can be positioned at any selected one of a plurality of orientations. The complementary connector similarly includes a pair of keys having keying portions which are also positioned at selected orientations, and as is known to those skilled in the art, if the keys of connector 10 and the keys of the complementary connector are properly oriented with respect to each other, the keying portions thereof pass by each other as the connectors are mated, permitting the connectors to properly mate. If, however, the keys are not properly oriented with respect to one another, the keying portions impinge against one another during attempted mating to prevent the connectors from being mated. The keying system thus permits connector 10 to mate with only the proper complementary connector and not with an incorrect complementary connector.

Figure 2A:
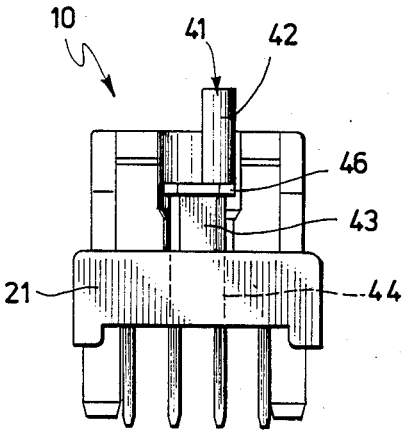
FIGS. 2A and 2B are side views of the connector assembly of FIG. 1 illustrating the keys of the connector assembly in programmable and programmed positions, respectively.
Figure 2B:
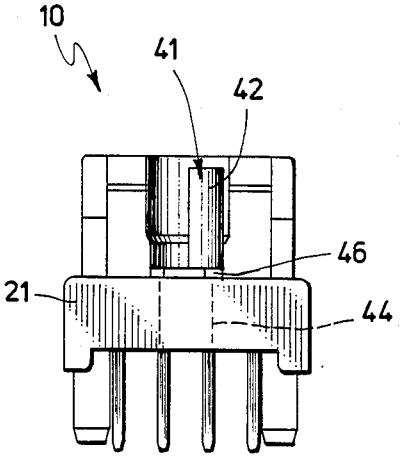

As shown in FIGS. 1, 2A and 2B, keys 41 include a polygonal-shaped body portion 46, preferably of hexagonal shape, to define as many possible key orientations as sides of the polygon. In the preferred embodiment of a hexagonal shaped body 46, there are six possible orientations of the keys. Keys 41 also include a semicircular keying portion 42 extending upwardly from the body portion, and a retention portion 43 extending downwardly from the body portion and adapted to extend into key-receiving passageways 44 in connector housing 21. More particularly, keys 41 are adapted to be first inserted into passageways 44 in a programmable first position, illustrated in FIG. 2A, in which the keys are partially inserted into the passageways and retained therein in a predetermined orientation such that they are capable of being rotated to orient the keying portions of the keys to any selected one of the plurality of possible orientations; and, thereafter, seated into a programmed second position (FIG. 2B) in which the keys are fully inserted in the passageways to lock the keys in the connector in the selected orientation.

With the keying system illustrated in FIGS. 1, 2A, and 2B, the manufacturer can insert the keys in the connector in the programmable first position illustrated in FIG. 2A and ship the assembled connector having unprogrammed keys to a customer. The customer can then program the keys of the connector by rotating the keys to a selected orientation and then locking the keys in the connector in their programmed second position illustrated in FIG. 2B prior to mounting the connector to a printed circuit board.

Connector 10 does not form a part of the present invention and is only briefly described herein to permit a clearer understanding of the programming and transfer system of the invention. Connector 10 and the keying system therefor is, however, described in greater detail in copending U.S. patent application Ser. No. 090,291 filed on Aug. 31, 1987, the disclosure of which is incorporated herein by reference.

Figure 3:
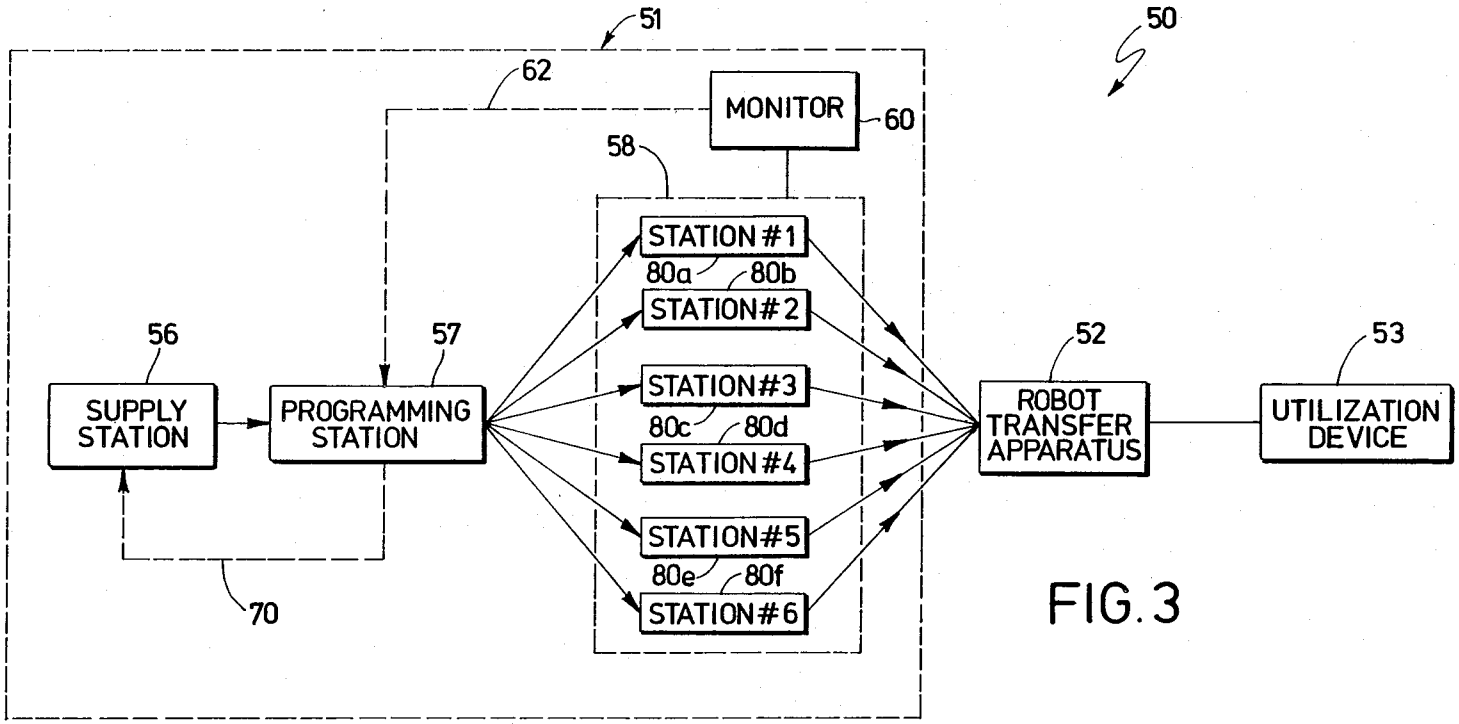
FIG. 3 schematically illustrates an automatic key programming and connector transfer system according to a presently preferred embodiment of the invention.

FIG. 3 schematically illustrates an automatic key programming and connector transfer system according to a preferred embodiment of the invention. The system is generally designated by reference numeral 50 and includes a key programming apparatus, generally designated by reference numeral 51, for programming the keys of the connectors such as connector 10; and robotic transfer apparatus 52 for transferring connectors having programmed keys from programming apparatus 51 to a utilization device 53 such as a printed circuit board.

The programming apparatus includes a supply station 56 for storing a supply of connectors having keys in the programmable first position, a programming station 57 for receiving the connectors from the supply station, for programming the keys of the connectors pursuant to programming instructions and for securing the keys in the programmed second position, and an output station 58 for receiving connectors having keys secured in the programmed second position from the programming station. As will also be explained more fully hereinafter, programming station 57 includes a programming device which is responsive to the programming instructions to program the keys of a connector by rotating the keys 41 thereof to a desired orientation while the keys are in the programmable first position partially inserted in passageways 44, and to thereafter seat the keys fully into passageways 44 to lock the keys in the programmed second position. As will be explained hereinafter, the programming device is controlled from the output station 58 via a signal line 62; and the transfer of connectors having unprogrammed keys from supply station 56 to programming station 57 is preferably controlled by signals from the programming station to the supply station along signal line 70.

Figures 4, 7:
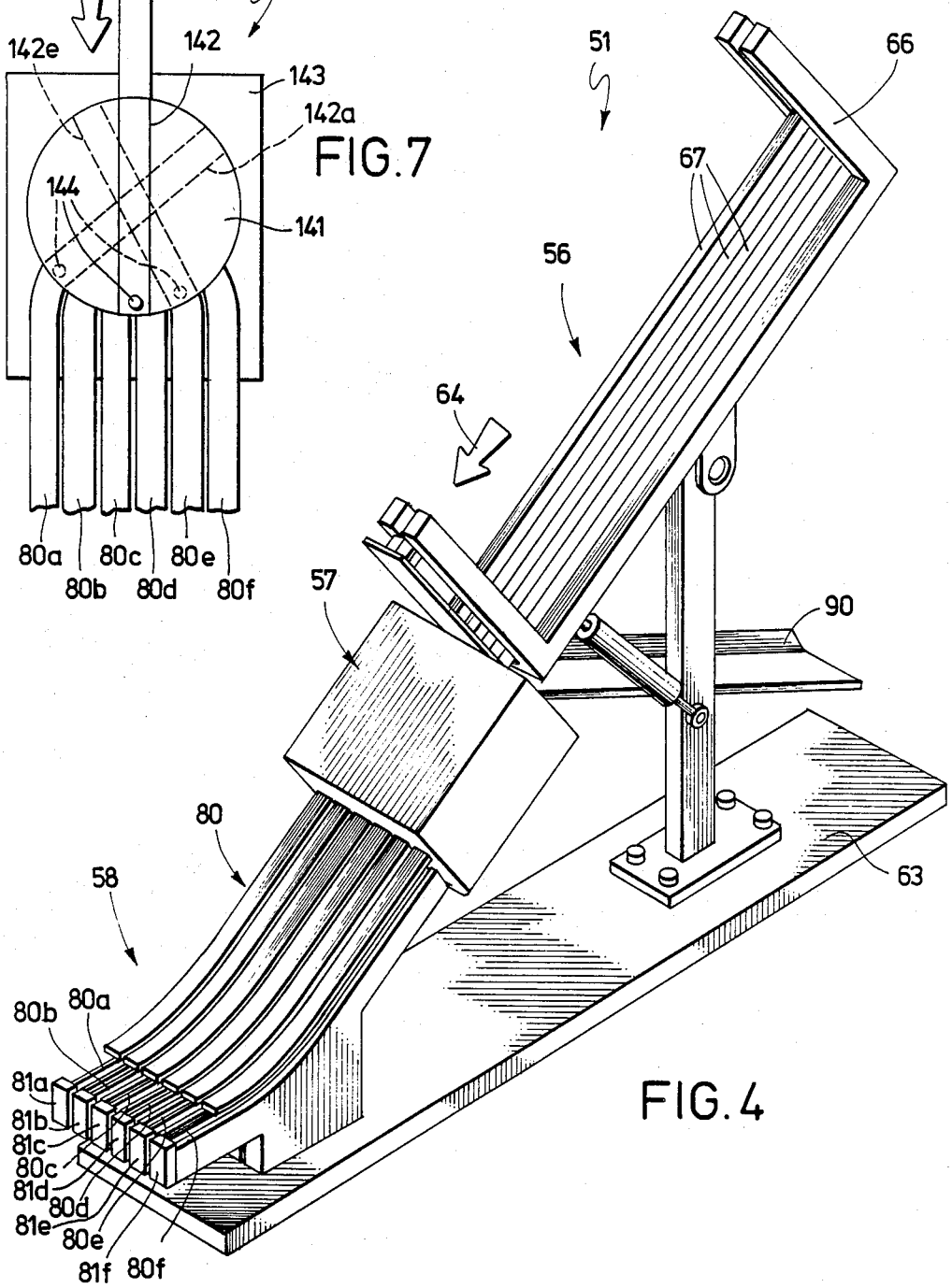
FIG. 4 illustrates the automatic key programming apparatus of the system of FIG. 3.
FIG. 7 illustrates a portion of the second delivery structure of the automatic key programming apparatus of FIG. 4.

As shown in FIGS. 3 and 4, output station 58 includes a plurality of separate output station sections **80*a*–80*f*, typically equal in number to the number of possible programmed states of the connectors being programmed by the apparatus; i.e., six in the case of a connector 10 having a hexagonal shaped body 46. Each section is adapted to receive connectors having programmed keys from programming station 57 which has been programmed to a key orientation or state corresponding to that section. Programming station 57** includes means for delivering connectors having programmed keys to the appropriate output station section depending upon the state to which the keys have been programmed.

Each output station section **80*a*–80*f* is sized to store a plurality of connectors having programmed keys, for example, five to ten connectors, in position to be picked up as needed by robotic transfer apparatus 52 or manually to be transferred to utilization device 53. The output station further includes monitoring means 60 for monitoring each output station section. When monitoring means 60 detects during use of the system, that the number of connectors in any output station section has decreased to a predetermined value, e.g., three connectors, signals are sent on line 62** to the programming station to program the keys of additional connectors to the programmed state stored in that particular output station section and to deliver the connectors having programmed keys to that station section to replenish the connector supply therein.

With the system of FIG. 3, the key programming apparatus automatically programs the keys of keyed but unprogrammed connectors as needed to maintain an adequate supply of connectors having keys programmed to a desired orientation or state at each section the output station. The robotic transfer apparatus automatically picks up connectors from the appropriate section of the output station, as determined by the key orientation desired, also as needed, and transfers and positions the connectors on a utilization device.

The programming apparatus and the robotic transfer apparatus operate entirely independent from one another, and together, provide a system which operates efficiently without operator intervention and with reduced potential for error.

FIG. 4 illustrates the automatic programming apparatus 51 of automatic key programming and connector transfer system 50. Apparatus 51 includes a supply station 56, a programming station 57, and an output station 58 which are positioned in alignment with one another along an inclined path relative to a support 63. The inclined path is generally identified by arrow 64 and permits connectors to move from the supply station to the programming station and from the programming station to the sections of the output station by gravity during operation of the apparatus.

Supply station 56 comprises an inclined frame 66 configured to support a plurality of plastic tubes 67 stacked one above the other. Each tube 67 is adapted to be filled with a plurality of connectors 10 (e.g., six or more connectors) arranged in a line one behind the other within the tube (see FIGS. 5A–5D). Plastic connector tubes 67 are known in the art as a convenient means for storing and transporting connectors and need not be described in detail herein.

Connectors 10 in tubes 67 have keys 41 partially inserted in passageways 44 thereof in the unprogrammed first position. The keys in this position are said to be unprogrammed. The connectors are preferably arranged in the tubes with the keying portions 42 of the keys extending upwardly.

Figures 5A, 5B, 5C, 5D:
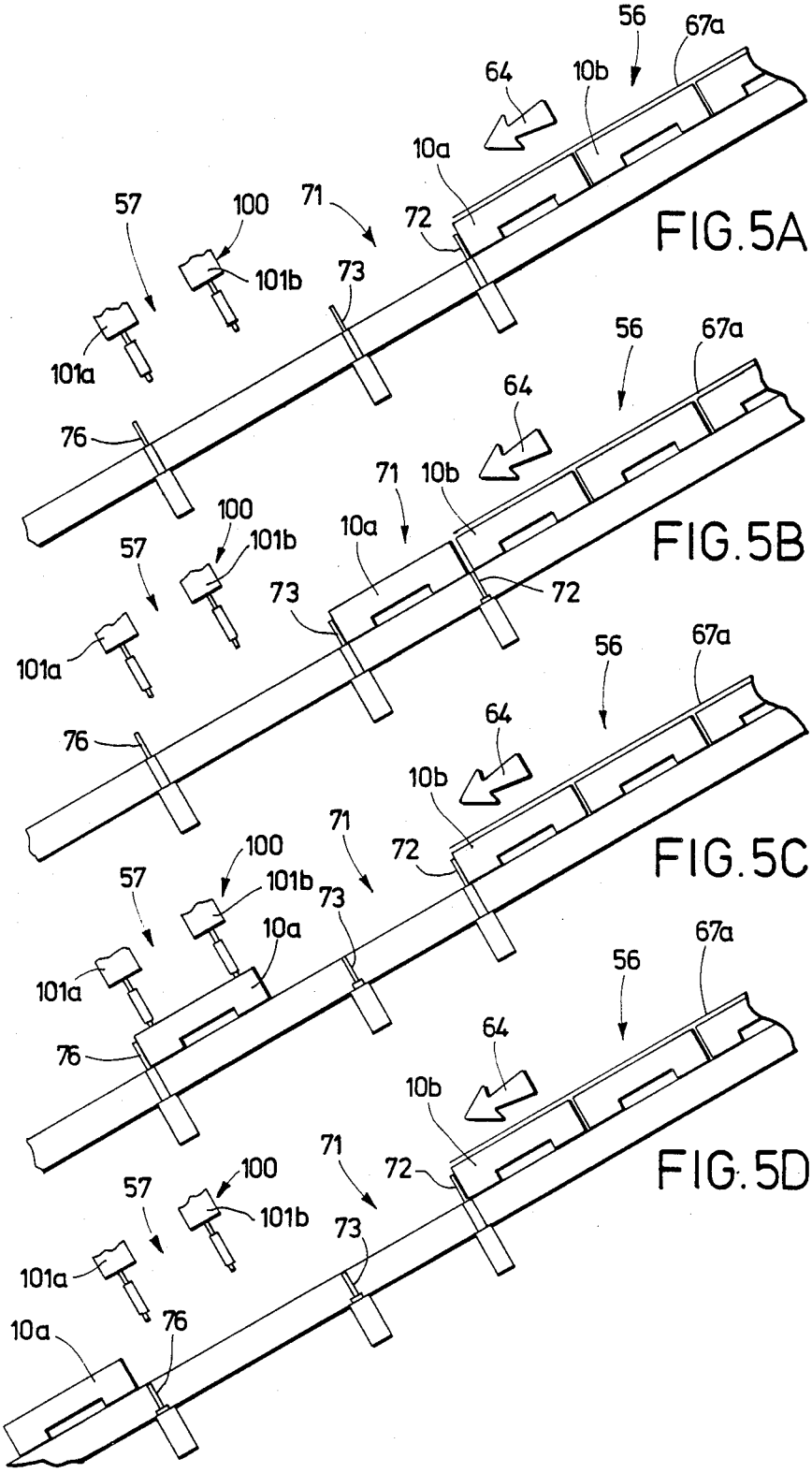
FIGS. 5A, 5B, 5C and 5D illustrate the operation of the automatic key programming apparatus of FIG. 4.

Supply station 56 also includes first delivery structure (see FIGS. 5A–5D), generally designated by reference numeral 71, for delivering connectors, one at a time, from supply station 56 to programming station 57. The first delivery structure can take various forms but in the embodiment described herein essentially comprises an escapement mechanism comprising a pair of switch-operated gates in the form of pins 72 and 73 which are adapted to move up and down in sequence to permit connectors to be delivered, one at a time, from the lowermost supply tube 67*a* in the stack of tubes 67 in supply station 56 to the programming station. More particularly, gates 72 and 73 are initially in their up position illustrated in FIG. 5A such that gate 72 blocks the front of tube 67*a* to prevent a connector from sliding out of the inclined tube by gravity. To deliver a connector from tube 67*a* to the programming station, the rear gate 72 is lowered, allowing the connectors to slide forwardly by gravity until the first connector 10*a* impinges upon front gate 73 as shown in FIG. 5B. Gate 73 is positioned approximately one connector length in front of tube 67*a* such that only the front connector 10aactually leaves the tube 67*a*. Rear gate 72 is then raised and, thereafter, front gate 73 is lowered as shown in FIG. 5C to permit connector 10*a* to slide by gravity into the programming station while blocking the movement of any further connectors from tube 67*a*.

Thus, first delivery structure 71 permits connectors to be delivered one at a time to programming station 57. The first delivery structure is operated by signals from the programming station on line 70 as illustrated in FIG. 3 and as will be described more fully hereinafter.

When connector 10*a* enters programming station 57, the connector is stopped in a programming position by any suitable structure such as, for example, a switch-operated gate 76. While in the programming position, the connector 10*a* is programmed by rotating the keys 41 thereof to a desired orientation; and, thereafter, seating the oriented keys fully into passageways 44 of the connector to lock the keys in their programmed second position in the connector.

Figure 6:
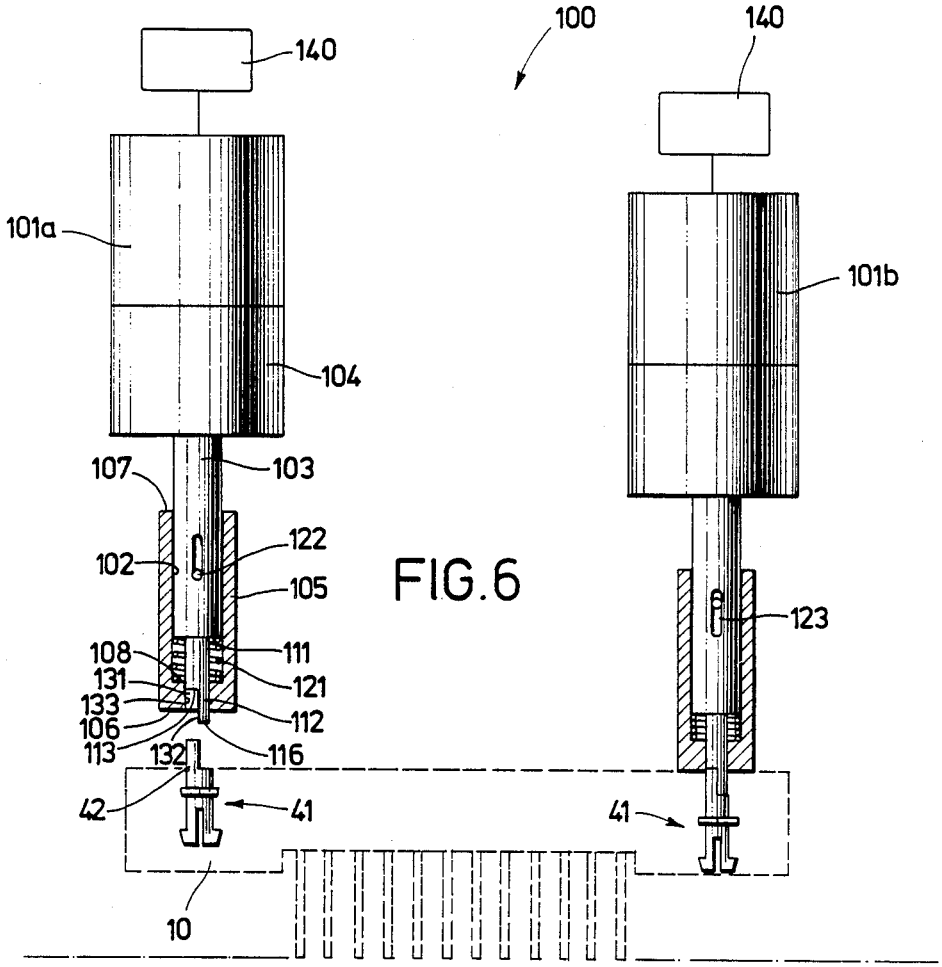
FIG. 6 illustrates the key programming device in the programming station of the automatic key programming apparatus of FIG. 4.

Programming the keys of the connector 10*a* is accomplished by a programming device 100 which comprises a pair of programming tools 101*a* and 101*b* as shown in FIG. 6. Tools 101*a* and 101*b* do not in themselves form a part of the present invention, and, accordingly are only briefly described herein. A hand tool similar to that which may be used herein is, however, described in detail in copending U.S. patent application Ser. No. 090,292 filed Aug. 31, 1987, the disclosure of which is herein incorporated by reference.

Tools 101*a* and 101*b* are identical and thus only tool 101*a* will be described herein. Tool 101*a* comprises a tubular-shaped sleeve 105 having an axial bore 102, an elongated cylindrical member 103 supported within sleeve 105, and a support member 104 attached to cylindrical member 103. The components can be constructed of steel or other suitable material.

Bore 102 of sleeve 105 extends from forward end face 106 to rear face 107 and includes a portion of reduced diameter adjacent its forward end to define a rearwardly facing, internal, annular shoulder 108. Member 103 is of generally cylindrical shape and is sized so as to be capable of sliding longitudinally within bore 102. Member 103 includes a cylindrical portion of slightly reduced diameter adjacent the front end thereof to define a forwardly facing shoulder 111 thereon. Member 103 also includes an extended portion 112 extending from the front face 113 thereof which is of generally semicircular cross section. Extended portion 112 defines a forwardly facing surface 116.

As shown in FIG. 6, cylindrical member 103 is adapted to extend through sleeve 105. A portion of the cylindrical member extends outwardly from rear face 107 of sleeve 105 and is adapted to be secured to support member 104 by any suitable structure.

Cylindrical member 103 is supported within sleeve 105 by resilient means, such as a spring 121. Spring 121 is positioned within sleeve 105 such that one end thereof bears against rearwardly facing shoulder 108 on sleeve 105 and the opposite end bears against forwardly facing shoulder 111 on cylindrical member 103. Spring 121 normally urges the cylindrical member rearwardly within sleeve 105 to a first retracted position illustrated in tool 101*a* in which the cylindrical member is substantially retracted within sleeve 105 (with only a small portion of extended portion 112 of member 103 extending beyond forward end face 106 of sleeve 105), but permits relative longitudinal movement of the cylindrical member relative to the sleeve.

Cylindrical member 103 is also connected to sleeve 105 by a pin 122 which extends through an elongated slot 123 in the sleeve as shown in tool 101*b*. The pin and slot arrangement permits relative axial movement between cylindrical member 103 and sleeve 105 but prevents relative rotation therebetween.

Tools 101*a* and 101*b* are used to both orient and then seat the two keys 41 of a connector 10 when the connector is positioned in the programming station. Initially, when a key 41 is in its programmable first position, a tool is positioned over the key such that extended keying portion 42 of the key is received in a space 131 that is defined between a side-facing, flat surface 132 of semi-circular, extended portion 112 of cylindrical member 103, and a sidewall 133 of the reduced diameter portion of bore 102. When the extended portion of the key is properly positioned in space 131, the tool is rotated about its axis, and surface 132 functions as a first bearing surface bearing against the extended portion 42 of key 41 to rotate the key to a desired orientation. Rotation of the tool to the desired orientation is preferably accomplished by a stepping motor schematically illustrated at 140 which rotates the tool and, hence, the key to any one of, e.g., six possible angular orientations, as determined by programming instructions.

After the key is rotated to a desired orientation, as determined by programming instructions, support member 104 is pushed down by any suitable structure to seat the oriented key fully into connector passageway 44 to lock the key in the programmed second position within the passageway. As the support member is pushed down, forward-facing surface 106 of sleeve 105 bears against the outer surface of the connector and is prevented from moving forward. Cylindrical member 103, however, moves forward to a second extended position (as shown in tool 101*b*) to push the key into its programmed second position, thereby securing the key in the connector in a programmed orientation. Forwardly facing surfaces 113 and/or 116 function as second bearing surfaces pressing against the key to push the key into the passageway to its programmed second position. Following seating of the key, the tool is raised and spring 121 urges the cylindrical member back to its first retracted position.

Programming device 100 can be a pair of tools 101*a* and 101*b* as shown in FIG. 6 designed to operate individually or together. Alternatively, device 100 can be a single tool and either the tool or the connector can be movable within the programming station to align the tool relative to the keys.

After the keys of a connector 10 have been programmed in programming station 57, gate 76 (FIG. 5D) is retracted to allow the connector having programmed keys to slide along inclined path 64 from the programming position toward the output station 58 of the apparatus. Gate 76 together with a distributor 139, which is not shown in FIGS. 5A–5D but which is illustrated in FIG. 7 and will be described hereinafter, comprises second delivery structure for delivering connectors having programmed keys from the programming station 57 to output station 58. As connector 10*a* leaves the programming position, it actuates a switch or the like (not shown) to immediately cause a signal to be sent from the programming station to the supply station along signal line 70 to cause the next connector 10*b* to be delivered from the lowermost tube 67*a* to the programming station to be in position for the next key programming operation.

Output station 58 comprises an elongated inclined chute 80 having a plurality of separate tracks 80*a*–80*f* arranged side-by-side therealong. Each of the tracks 80*a*–80*f* is adapted to receive and store a plurality of connectors having programmed keys from programming station 57. More particularly, each track is adapted to receive and retain a connector in which the keys have been programmed to a predetermined one of the plurality of possible states or key orientations. In the preferred embodiment connector 10 has keys 41 which have a hexagonal shaped body 46 and are therefore rotatable to six possible orientations. Chute 80 includes six tracks 80*a*–80*f* for storing connectors having keys programmed to each of the six possible programmed states. Each track is preferably sized to store a relatively small plurality of connectors, for example, five to ten connectors, arranged adjacent each other, so that they are available to be picked up manually or automatically as they are needed. When a connector having a key orientation is needed, it is picked up from the end of the appropriate track which stores connectors having the desired key orientation and transferred to and positioned on a utilization device 53 (FIG. 3). The remaining connectors on the track then slide down the track and engage a respective stop 81*a*–81*f* such that the next connector will be positioned at the end of the track to be picked up when needed.

Delivery of a connector from programming station 57 to the appropriate track 80*a*–80*f* is accomplished by a distribution device 139, illustrated in FIG. 7. More particularly, when a connector having programmed keys has been released by gate 76 (FIG. 5D), the connector slides along inclined path 64 into distributor 139. Distributor 139 can take a variety of forms but in the embodiment illustrated, comprises a disc-shaped member 141 having a slot 142 extending diametrically thereacross. Disc-shaped member 141 is rotatably mounted to a support 143 for rotation from between a first connector pick-up position illustrated in solid line in FIG. 7, wherein slot 142 is aligned with the inclined path 64, to any one of the plurality of output station sections 80*a*–80*f*, each of which defines a connector output position wherein slot 142 is aligned with one of the output station section tracks 80*a*–80*f*. FIG. 7 illustrates, in dotted line, slot 142 in connector output positions 142*a* and 142*e* in which slot 142 is aligned with tracks 80*a* and 80*e*, respectively.

In operation, when the keys of a connector have been programmed and the connector is released by gate 76, the connector slides along inclined path 64 and into slot 142 of distributor 139 when the slot is aligned with track 64 in the connector pick-up position. Disc 141 is then rotated to the appropriate connector output position to slot 142 with the particular track which is adapted to store the connector, depending on the state to which the keys thereon have been programmed. With disk 141 rotated from the connector pick-up position such that slot 142 is aligned with one of tracks 80*a*–80*f*, the connector having programmed keys slides out of the slot by gravity, into and down the aligned track.

Disk 141 may require a gate 144 to temporarily block connector 10 in slot 144 as connector 10 is received in slot 142 at the connector pick-up position and during rotation of disk 141 to a connector output position. Gate 144 is retracted at the connector output position to permit the connector to slide out of slot 142 into the aligned track at the connector output position. Gate 144 is controlled by the same signals that control the operation of disk 141.

If desired, a connector having programmed keys can be picked up and carried from the output station to the utilization device 53 by hand. In accordance with a presently preferred embodiment of the invention, however, the connector transfer is accomplished automatically by a robotic transfer apparatus 52 (FIG. 3). More particularly, robotic transfer apparatus 52, which may be of conventional type and, therefore, need not be described in detail herein, is designed to pick up a connector having programmed keys from the end of the appropriate track 80*a*–80*f* of chute 80 depending on the particular key programmed state desired, transfer the connector to a utilization device 53, i.e. a printed circuit board, and position the connector on the utilization device in the proper location thereon. After a connector is properly positioned on device 53, the robotic transfer apparatus returns to the output station to pick-up the next connector that is required, and in this way the robotic transfer apparatus is able to operate in a continuous automatic manner to position a plurality of connectors on one or a series of utilization devices.

Output station 58 further includes monitoring means 60, schematically illustrated in FIG. 3, to monitor each of the output tracks 80*a*–80*f*. Monitoring means 60 may comprise a plurality of photosensors, a plurality of mechanical switching devices or other suitable devices which are adapted to monitor each of the tracks 80*a*–80*f* to ensure that each track has an adequate supply of connectors available thereon to be picked up for use when needed. When the number of connectors having programmed keys in any track decreases to a predetermined value, for example, three connectors, the monitoring means generates signals along line 62 to programming station 57 causing programming device 100 to begin programming the keys of connectors to the programmed state needed to replenish the supply on that particular track. This signal also controls distributor 139 to assure that the connectors having keys programmed to a particular orientation are delivered to the appropriate track 80*a*–80*f*. Thus, if monitoring means 60 detects that the number of connectors in track 80*a* has decreased to three connectors, a signal is generated on line 62 to provide programming instructions to the programming device to program the keys of several connectors to the programmed state needed to replenish the supply on track 80*a*. Signals are also sent to distributor 139 to direct the distributor to deliver the connectors to track 80*a*.

With the present invention, therefore, a limited but adequate supply of connectors having keys programmed to each possible programmed state is available for use at all times without the necessity to maintain a large inventory of connectors having keys programmed to each of the possible key orientations or states. The connectors are maintained with keys in an unprogrammed state until the supply of connectors with keys programmed to a particular state has diminished to a level where it is desirable to replenish the supply. In general, the apparatus programs the keys of connectors only as they are needed for increased efficiency.

The automatic key programming apparatus of the invention operates totally independently of the utilization device 53 or of the particular means used for transferring connectors to the utilization device. This provides the operator with greater flexibility in using the apparatus in different applications, and makes the overall key programming and transfer system less complex.

Figure 8:
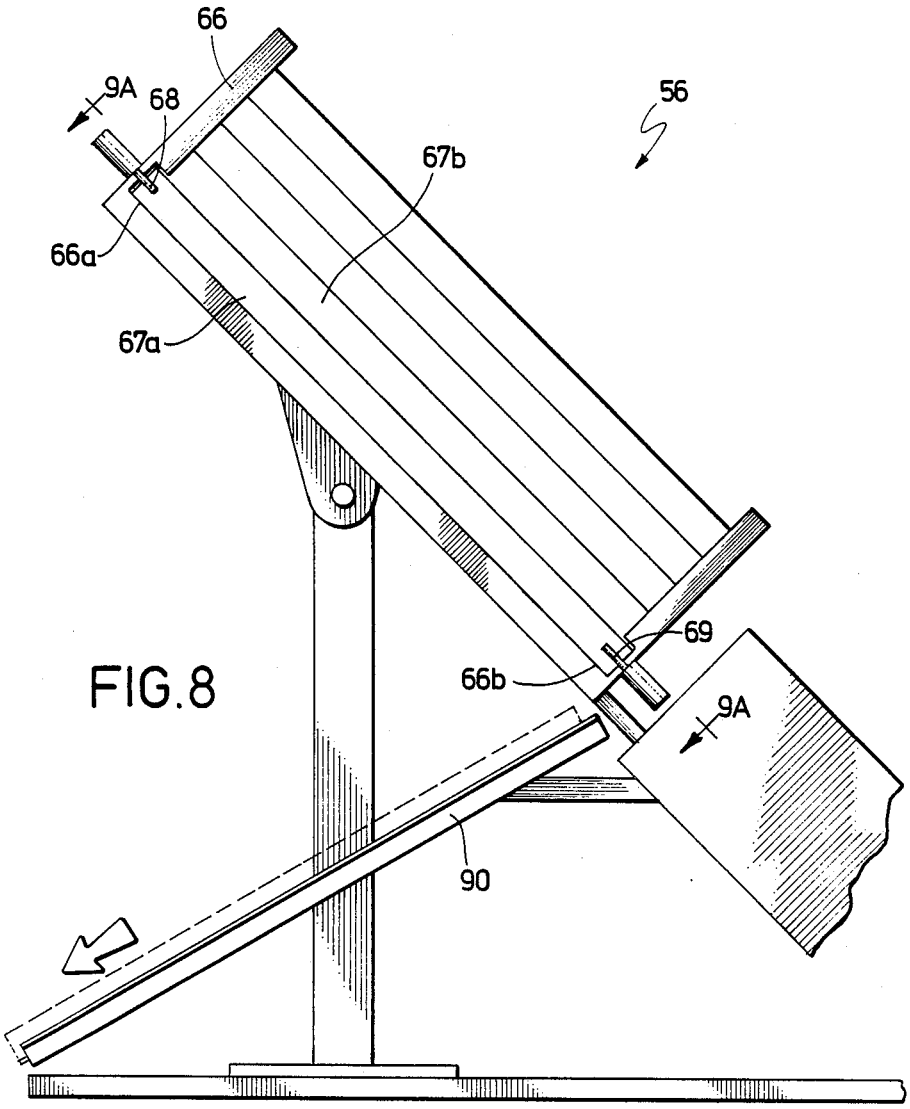
FIG. 8 is a rear view of the supply station in the automatic key programming apparatus of FIG. 4.
Figure 9A:
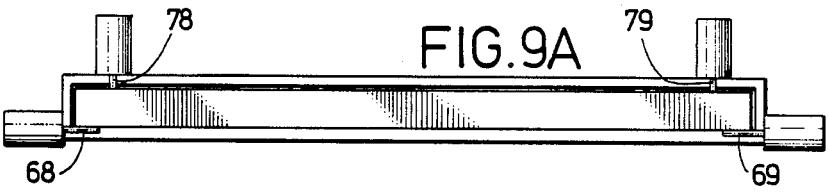
FIGS. 9A and 9B are cross-sectional views of the supply station of FIG. 8 looking in the direction of arrows 9A—9A in FIG. 8 to help explain a feature of the supply station.
Figure 9B:
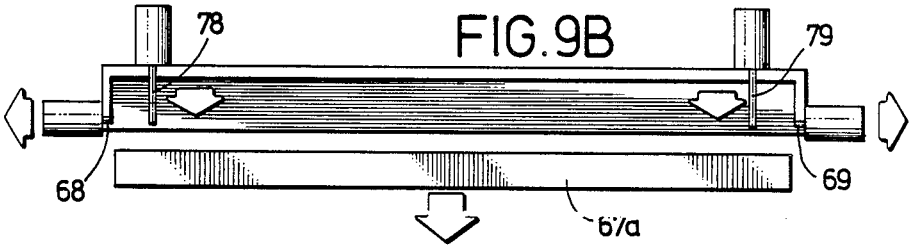

When the lowermost tube 67*a* in supply station 56 of automatic programming apparatus 51 is empty, it is necessary to remove the empty tube from frame 66 and to move the next tube 67*b* of the stack of tubes in position to dispense connectors to the programming station. One suitable mechanism for accomplishing this is illustrated in FIGS. 8, 9A and 9B. More particularly, FIG. 8 is a rear view of supply station 56 of programming apparatus 51 to illustrate that frame 66 includes cut-out portions 66*a* and 66*b* adjacent the bottoms of the front and back walls of the frame. The cut-out portions 66*a* and 66*b* are positioned and sized to permit the lowermost tube 67*a* in the stack of tubes to be pushed laterally from the frame, while preventing any other tubes in the stack from being pushed from the frame. Withdrawal of tube 67*a*, through the cut-outs, however, is normally prevented by a pair of switch operated gates 68 and 69 which block the cut-outs as shown in FIGS. 8 and 9A.

When the lowermost tube 67*a* has been emptied, however, a signal causes gates 68 and 69 to be retracted to the positions illustrated in FIG. 9B in which the gates no longer block the cut-outs 66*a* and 66*b*. Thereafter, a pair of switch operated pusher rods 78 and 79 are actuated to push the empty tube laterally out of the frame as shown in FIGS. 9A and 9B onto a slide 90 to be carried away from the apparatus. Pusher rods 78 and 79 are thereafter retracted back to the positions shown in FIG. 9A allowing the next tube 67*b* in the stack of tubes to fall down the frame by gravity into position to deliver connectors therefrom to the programming station. Gates 68 and 69 are also returned to their FIG. 9A position blocking recesses 66*a* and 66*b* to prevent the new tube 67*b* from accidentally falling out of the frame.

To replace a connector not properly positioned on the utilization device, the robotic transfer apparatus merely returns to the same track to acquire a connector having keys programmed in the same orientation as the previous connector.

In accordance with known keying techniques, when a connector has two keys, they are typically oriented in the same orientation giving a very limited number of unique key orientation combinations. The invention is not limited to programming two keys on a connector to the same key orientation. This invention may be used to program two keys on a connector to different orientations. Keying two keys on a connector to different orientations, as is known in the art, results in a significantly greater number of unique key orientation combinations when compared to orienting both keys in the same orientation.

While what has been described herein comprises a presently preferred embodiment of the invention, it should be understood that the invention can take various other forms. For example, although the invention has been described primarily for use in connection with connector 10 described herein, it should be understood that the invention can be used to program the keys of a variety of connectors and transfer a variety of different connectors including connectors having keys which are adapted to be removed, added, or adjusted on a connector. Because the invention can take numerous forms, it should be understood that the invention should be limited only insofar as is required by the scope of the following claims.

I claim:

1. Apparatus for automatically programming keys of electrical connectors having keys programmable to any selected one of a plurality of programmed states comprising:

a supply station for storing a plurality of connectors having keys in an unprogrammed orientation;

a programming station for receiving connectors having keys in an unprogrammed orientation from said supply station and for programming the keys of the connectors, said programming station including a programming device for programming the keys of each connector to a particular programmed state in accordance with programming instructions applied thereto;

an output station for receiving connectors having keys programmed to a desired orientation from said programming station, said output station including a plurality of output station sections each of which are adapted to receive connectors which have keys programmed to a specific one of said plurality of programmed states; and monitoring means for monitoring each of said plurality of output station sections and for providing programming instructions to said programming device for maintaining a supply of connectors having keys progammed to a desired orientation in each of said plurality of output station sections.

2. The apparatus of claim 1 wherein said monitoring means comprises means for generating a signal to control said programming station to program the keys of connectors to the programmed state received and stored by an output station section when the number of connectors in said output station section decreases to a predetermined value.

3. The apparatus of claim 2 wherein said plurality of output station sections comprise a plurality of elongate tracks, each of said tracks being adapted to receive and store a plurality of connectors having keys programmed to a desired orientation.

4. The apparatus of claim 3 wherein each of said plurality of tracks comprises an inclined track whereby connectors slide down said tracks by gravity from the programming station toward bottom ends of said tracks.

5. The apparatus of claim 3 wherein said supply station includes first delivery structure for delivering connectors having keys in an unprogrammed orientation from said supply station to said programming station, and wherein said programming station includes second delivery structure for delivering connectors having keys programmed to a desired orientation one at a time from said programming station to one of said plurality of tracks of said output station.

6. The apparatus of claim 5 wherein said second delivery structure includes a distributor for directing each connector having keys programmed to a desired orientation from the programming station to the appropriate track as a function of the state to which a key of the connector is programmed.

7. The apparatus of claim 1 wherein said supply station includes a frame for supporting a plurality of elongated tubes, each of said plurality of tubes being adapted to carry a plurality of electrical connectors having keys in an unprogrammed orientation therein.

8. The apparatus of claim 7 wherein said plurality of elongated tubes are stacked one above the other in said supply station and wherein connectors are delivered one at a time from the lowermost tube in the stack to said programming station.

9. The apparatus of claim 1 wherein said electrical connectors include at least one key thereon said at least one key being supported within said connectors in an unprogrammed first position partially inserted in said connectors, and wherein said programming device comprises a programming tool for rotating said at least one key to a selected one of a plurality of orientations while said key is in said programming first position and for thereafter locking said at least one key in a programmed second position in said connector.

10. The apparatus of claim 1 wherein said supply station, said programming station and said output station are positioned along an inclined path to permit connectors to be delivered from said supply station to said programming station and from said programming station to said output station by gravity.

11. A system for programming keys of electrical connectors and for transferring the connectors having keys programmed to a desired orientation to a utilization device, said system comprising:

an automatic programming apparatus including:

a supply station for storing a plurality of connectors having keys in an unprogrammed orientation, each of said connectors having keys programmable to any selected one of a plurality of programmed states;

a programming station for receiving connectors having keys in an unprogrammed desired orientation from said supply station and for programming the keys of the connectors, said programming station including a programming device for programming the keys of a connector therein in response to programming instructions applied thereto; and an output station for receiving connectors having keys programmed to a desired orientation from said programming station, said output station including a plurality of output station sections, each of said output station sections being adapted to receive connectors which have keys programmed to a specific one of said plurality of programmed states; and monitoring means for monitoring each of said output sections, said monitoring means including means for controlling the operation of said programming device to program keys of connectors to programmed states as necessary for maintaining an adequate supply of connectors having keys programmed to a desired orientation in each of said plurality of output station sections; and robotic transfer apparatus for transferring connectors having keys programmed to a desired orientation from the output station sections of said automatic programming apparatus to a utilization device.

12. The system of claim 11 wherein said utilization device comprises a printed circuit board.

13. The system of claim 11 wherein said plurality of output station sections comprises a plurality of tracks, each of said plurality of tracks being adapted to receive a plurality of connectors which have keys programmed to a specific one of said plurality of programmed states, and wherein said monitoring means includes means for detecting when the number of connectors in any of said tracks decreases to a predetermined value.

14. The system of claim 11 wherein said supply station, said programming station and said output station are positioned along an inclined path to permit connectors to be delivered from said supply station to said programming station and from said programming station to said output station by gravity.

15. A method for automatically programming the keys of electrical connectors to any selected one of a plurality of programmed states, comprising:

delivering keyed but unprogrammed electrical connectors from a supply station to a programming station;

programming the keys of said connectors in said programming station in response to programming instructions;

delivering connectors having keys programmed to a desired orientation from the programming station to an output station, said output station including a plurality of output tracks each of which are adapted to receive and store connectors which have keys programmed to a desired orientation of said plurality of programmed states; and monitoring each of said output tracks and controlling programming of keys of connectors in said programming station to maintain an adequate supply of connectors having keys programmed to a desired orientation in each of said output tracks.

16. The method of claim 15 wherein said monitoring step comprises generating a signal when the number of connectors in a particular track decreases to a predetermined value, and thereafter controlling the programming keys of connectors in said programming station to program keys of connectors to the programming state received and stored in said particular track for replenishing the supply of connectors therein.

17. The method of claim 16 wherein said delivering steps comprise delivering connectors one at a time from said supply station to said programming station, and one at a time from said programming station to said output station.

18. The method of claim 17 wherein said delivering steps comprise delivering said connectors from said supply station to said programming station and from said programming station to said output station by gravity.

* * * * *